US006102209A

United States Patent [19]

D'Andrea

[11] Patent Number: 6,102,209

[45] **Date of Patent: *Aug. 15, 2000**

[54] COSMETIC PACKAGING

[75] Inventor: Daren Mark D'Andrea, Stamford, Conn.

[73] Assignee: Nadel Industries, Inc., Port Chester, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 09/103,246

[22] Filed: Jun. 23, 1998

[51] Int. Cl.[7] ..... B65D 69/00

[52] U.S. Cl. ..... 206/581; 206/823; 220/521; 220/529; 220/780; 220/4.25

[58] Field of Search ..... 206/581, 823; 220/521, 522, 529, 530, 780, 787, 789, 793, 555, 4.25, 4.23

[56] References Cited

U.S. PATENT DOCUMENTS

| | | | |
|---|---|---|---|
| D. 202,594 | 10/1965 | Hrolenok . | |
| D. 243,069 | 1/1977 | Igelman . | |
| 265,609 | 10/1882 | Johnston . | |
| D. 335,085 | 4/1993 | Wacker . | |
| D. 345,507 | 3/1994 | Granai . | |
| 2,604,976 | 7/1952 | Sarg . | |
| 2,661,139 | 12/1953 | Brooks | 229/160.1 |
| 4,593,817 | 6/1986 | Ferrero . | |
| 4,852,742 | 8/1989 | Scuorzo | 206/581 |
| 4,883,935 | 11/1989 | Fairchild et al. . | |
| 5,025,817 | 6/1991 | Wen | 206/581 |
| 5,035,935 | 7/1991 | Thomas et al. | 206/242 |
| 5,063,057 | 11/1991 | Spellman et al. . | |
| 5,064,082 | 11/1991 | Lombardi et al. . | |
| 5,472,542 | 12/1995 | Wermund | 220/522 |
| 5,728,414 | 3/1998 | Terrasi | 426/104 |
| 5,753,289 | 5/1998 | Ness | 220/555 |
| 5,758,794 | 6/1998 | Rider, Jr. et al. | 220/522 |
| 5,769,263 | 6/1998 | Willingham et al. | 220/522 |
| 5,791,473 | 8/1998 | Decker et al. | 220/522 |
| 5,792,496 | 8/1998 | Fekete et al. | 426/104 |
| 5,906,292 | 5/1999 | Rider, Jr. | 220/4.23 |
| 5,992,619 | 11/1999 | Milano | 206/216 |

*Primary Examiner*—Paul T. Sewell
*Assistant Examiner*—J. Mohandesi
*Attorney, Agent, or Firm*—Amster, Rothstein & Ebenstein

[57] ABSTRACT

A container is provided comprising a transparent dome shaped enclosure having a lower open end forming a cover of the container, a seal member extending across the open end for defining within the transparent dome shape enclosure a chamber for containing and displaying a product, and a lower enclosure forming a base portion of the container and having an upper open end for receiving a cosmetic related product. The dome shaped cover preferably includes a partition or dividing wall which divides the dome shaped chamber into a first and second compartment for containing and displaying at least two different products (i.e. two types of cosmetic related products).

9 Claims, 5 Drawing Sheets

FIG. 3
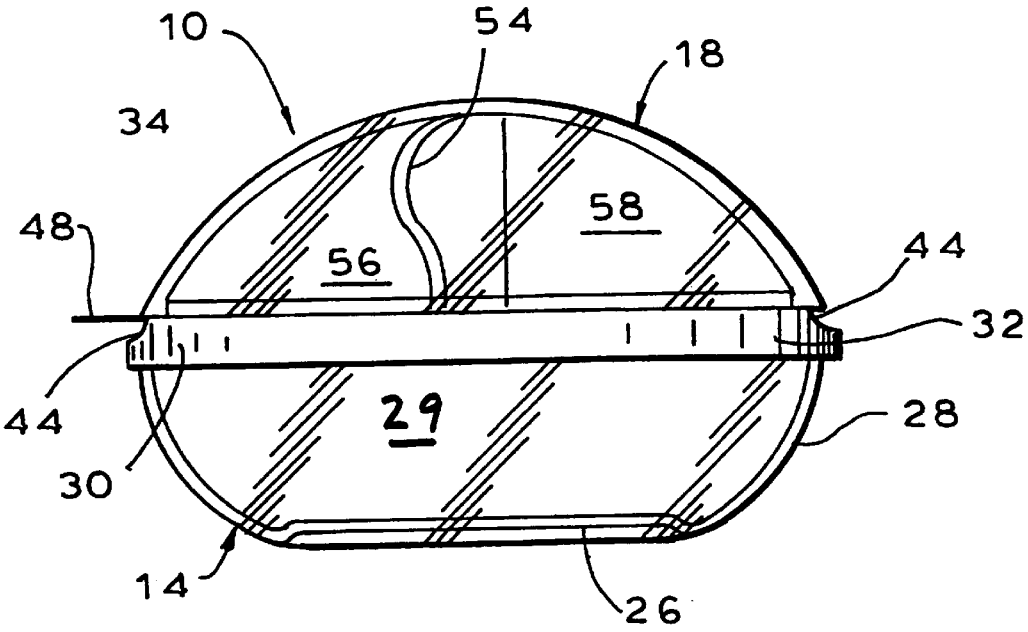
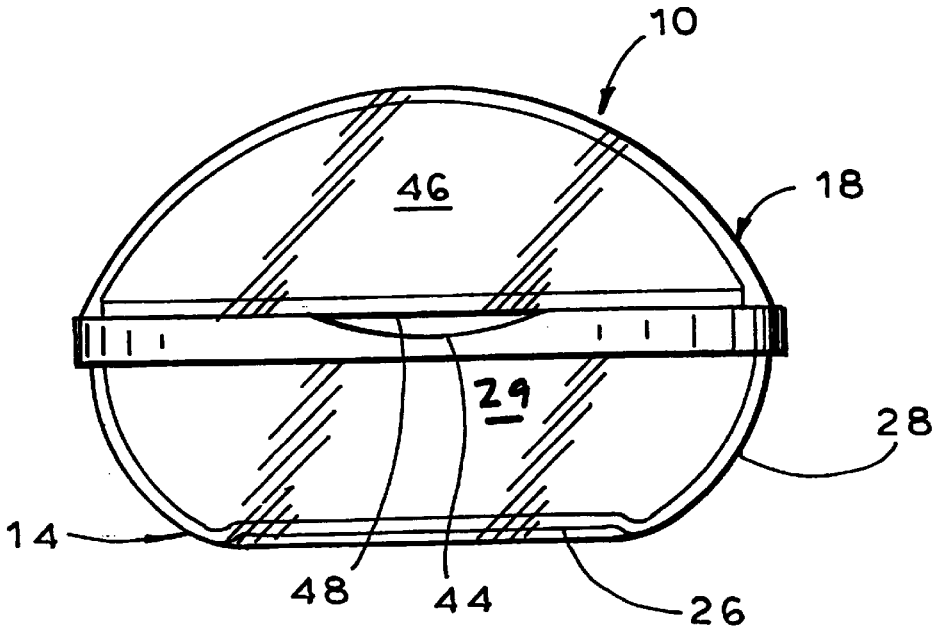
FIG. 4

FIG. 7
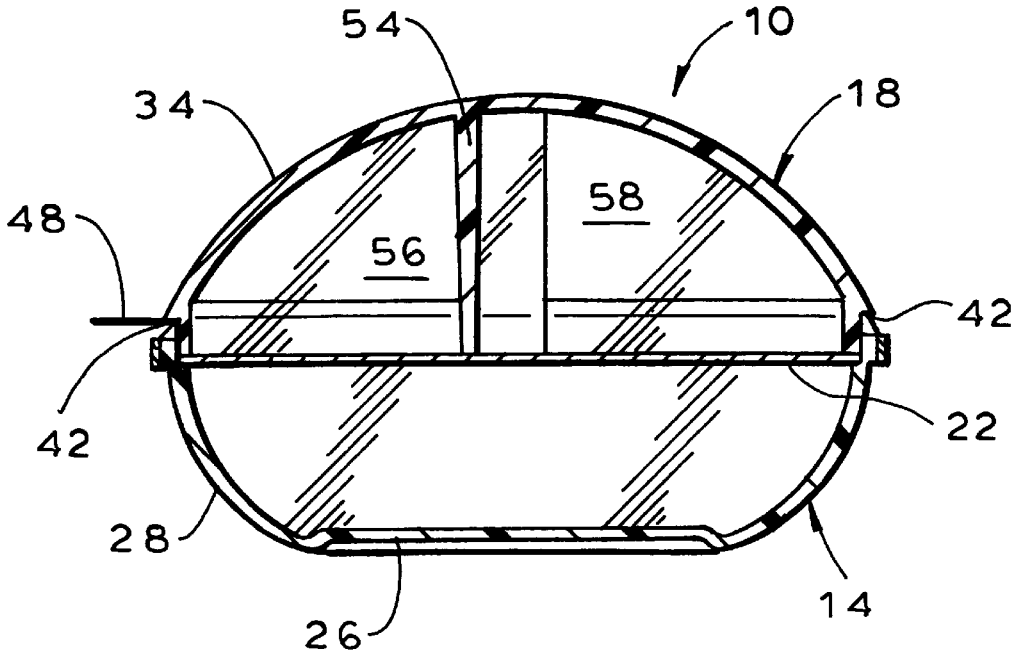
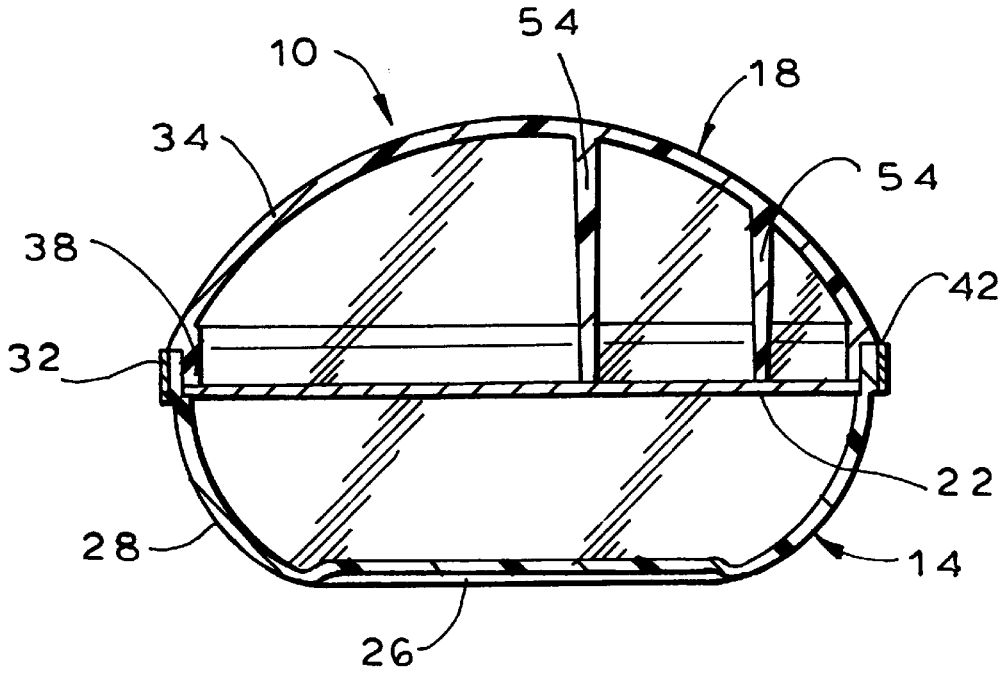
FIG. 8

COSMETIC PACKAGING

BACKGROUND OF THE INVENTION

1. Field of the Invention

The present invention relates generally to a container for containing and displaying a product, and in particular to a multi-piece container for cosmetic related products having at least one transparent section for viewing the contents within the container.

2. The Related Art

Any number of containers for containing cosmetic related products are available and well known in the art. In large part, the general shape of the container is dictated by the particular cosmetic related product to be held in the container. That is, over time, certain container shapes or styles have been adopted industry wide as the style of container to be used for a particular type of product. Examples of this industry wide acceptance can be seen in the similarity of the containers often used by different manufacturer to hold products such as nail polish and lipstick.

At least one reason for the uniformity in container design is the functional superiority of certain container designs. Another less obvious reason is that, in the past, cosmetic related products had not been designed to have any aesthetic value independent of the containers in which they were held. Recently, in an effort to distinguish their products, manufacturers have focused on designing products that are functional, yet unique and aesthetically appealing. For example, certain types of cosmetic eye and face treatments have been fabricated for sale in a capsular form rather than in their traditional forms, i.e., liquid or lotion. One advantage of the capsule is that it permits the product to be dispensed in a measured or metered quantity which controls waste and overuse of the product. A further advantage is that the a unique capsule design may act as a signature identifying a specific manufacturer to help distinguish its products from those of another in the mind of a consumer. Thus it is desirable for such capsules or otherwise decorative products to be prominently displayed within a container so as to be easily viewed by the consumers of such products. To that end, cosmetic packaging has been provided with a transparent section or window that permits the consumer to view the product through a sealed container.

One such container having a transparent portion is disclosed in U.S. Pat. No. 5,064,082. This patent discloses a container having a receptacle defining a lower portion of the container and a lid defining an upper portion of the container. The lid and receptacle are separated by a separate seal member positioned therebetween. As disclosed, the cosmetic products or contents are contained below the seal member and within the receptacle. The lid and seal member are transparent so that the products may be seen without actually opening the container.

Although the prior art container is generally effective in permitting the consumer to view its contents, the contents are not prominently displayed. In order for the consumer to view the products, the consumer must have a vantage point that allows the consumer to view the product first through the transparent lid and then through the transparent seal member. To the extent the consumer does not have such a vantage point, the decorative cosmetic-related product may be overlooked, thwarting the manufacturer's objective in using a uniquely designed product.

Thus, the need remain for a multi-piece container which contains and adequately displays the cosmetic-related products within.

In accordance with the present invention, it is an object to provide a container comprising a lower or base portion and a transparent upper or cover portion.

It is a further object to provide a container comprising a lower or base portion and a transparent upper or cover portion wherein the cover portion is closed off by a sealing member to define a display chamber within the cover portion.

It is still another object to provide a container comprising a lower or base portion and a transparent upper or cover portion including a display chamber which is divided by a partition to define first and second compartments for separately displaying and holding more than one product or more than one type of product in a single container.

SUMMARY OF THE INVENTION

In accordance with the above objects and additional objects which will become apparent hereinafter, the present invention provides a multi-piece container comprising a transparent dome shaped cover having an open end, a seal extending across the cover for closing off the open end and defining within the transparent cover a chamber for containing and displaying a product, and a lower section forming a base of said container for supporting said cover.

In a preferred configuration, the base includes an upper open end and defines a lower enclosure for receiving the product contained within the chamber. The base is preferably comprised of a transparent plastic material and the seal comprises a thin sheet of opaque foil, cardboard or paper which has been laminated across the open end of the cover.

The dome shaped cover may also include a sinuous partition or dividing wall which divides the dome shaped chamber into a first and second compartment for separately containing and displaying more than one type of cosmetic related product.

In a further aspect of the invention, the base may include a band positioned adjacent the upper end of the base for displaying identifying information regarding the product contained within the container.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanying drawings, wherein:

FIG. 3 is a side elevational view thereof;

FIG. 4 is a side elevational view thereof rotated 90°;

FIG. 7 is a cross-sectional view thereof, taken along the line 7—7 of FIG. 2; and FIG. 8 is a cross-sectional view thereof, taken along the line 8—8 of FIG. 2.

DETAILED DESCRIPTION OF THE PREFERRED EMBODIMENT

Figure 1:
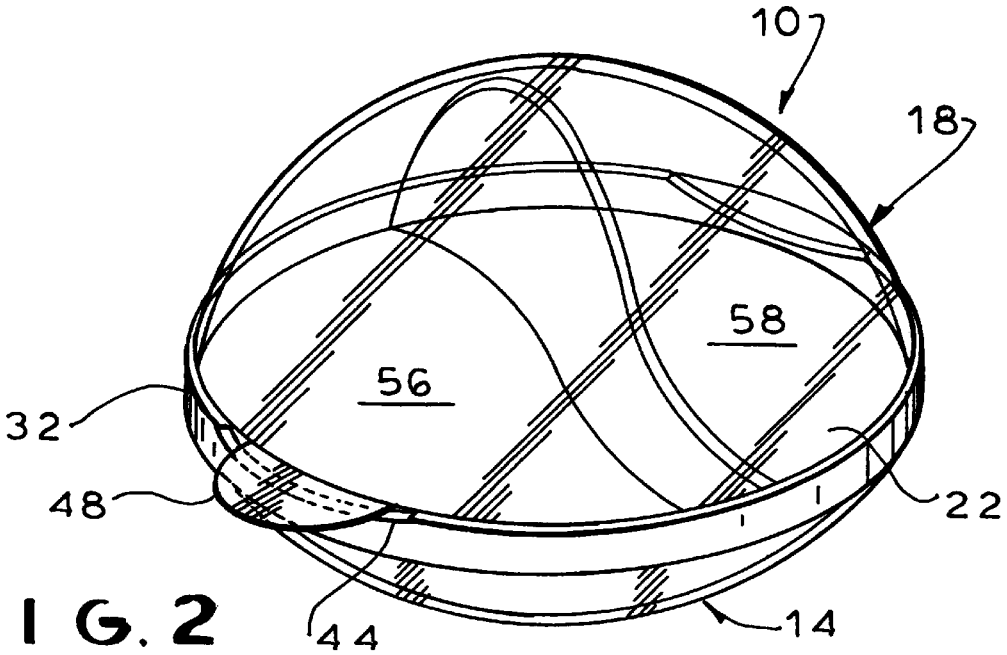
FIG. 1 is a top perspective view of a preferred embodiment of the container in accordance with the present invention.
Figure 2:
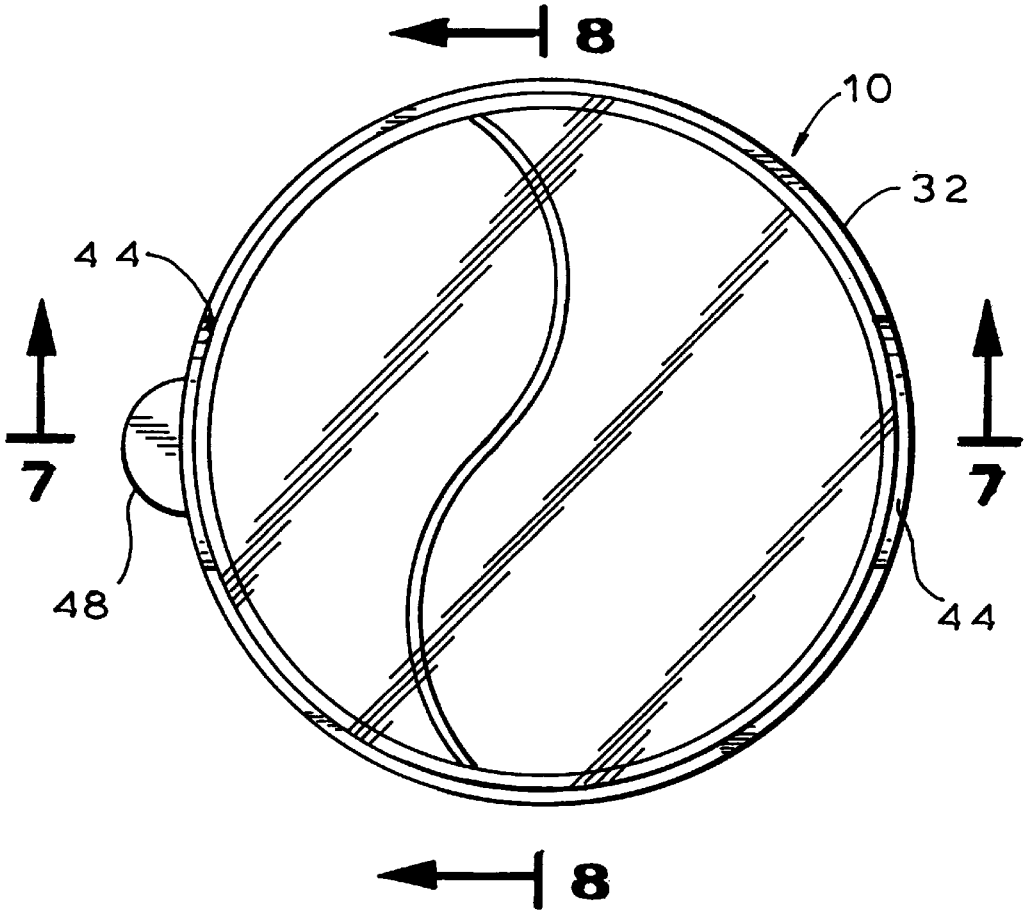
FIG. 2 is a top plan view thereof.
Figure 5:
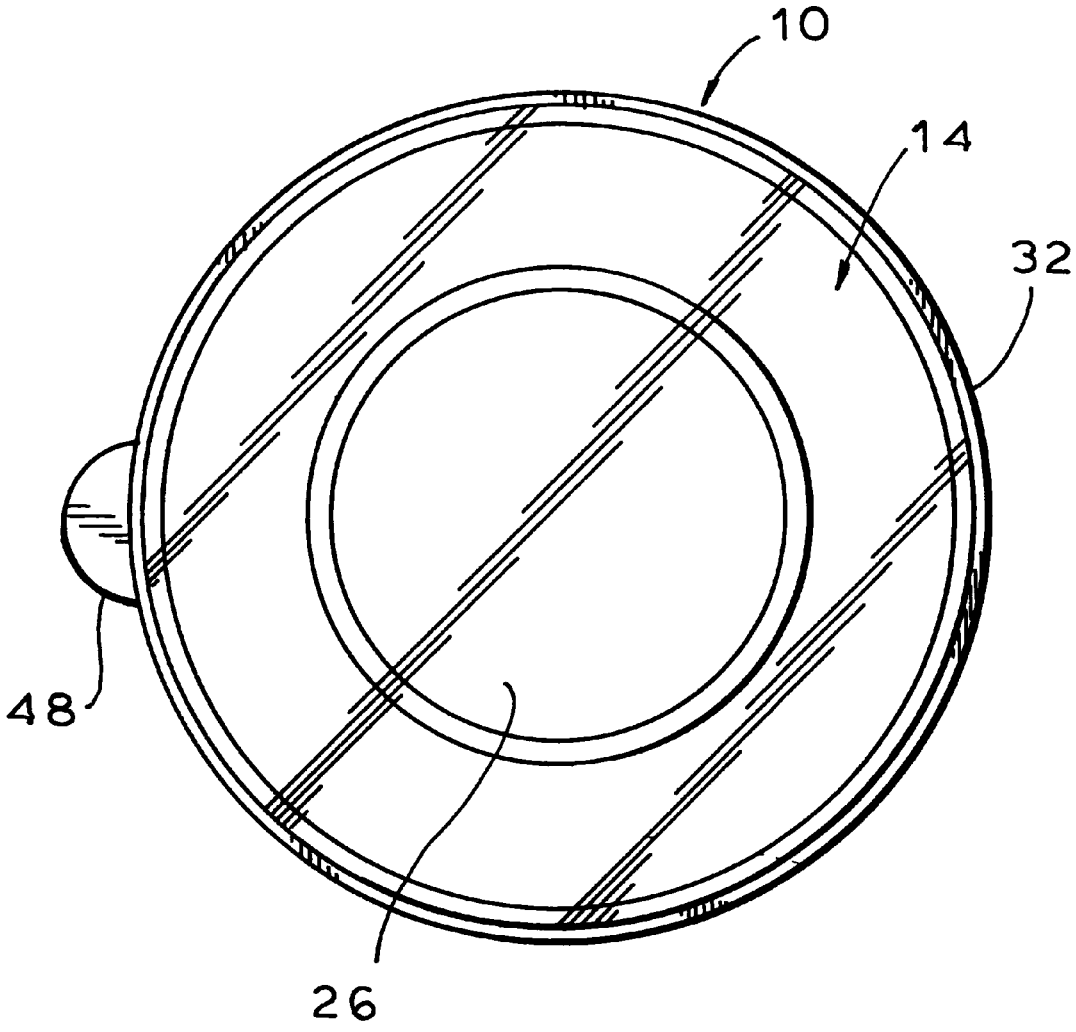
FIG. 5 is a bottom plan view thereof.
Figure 6:
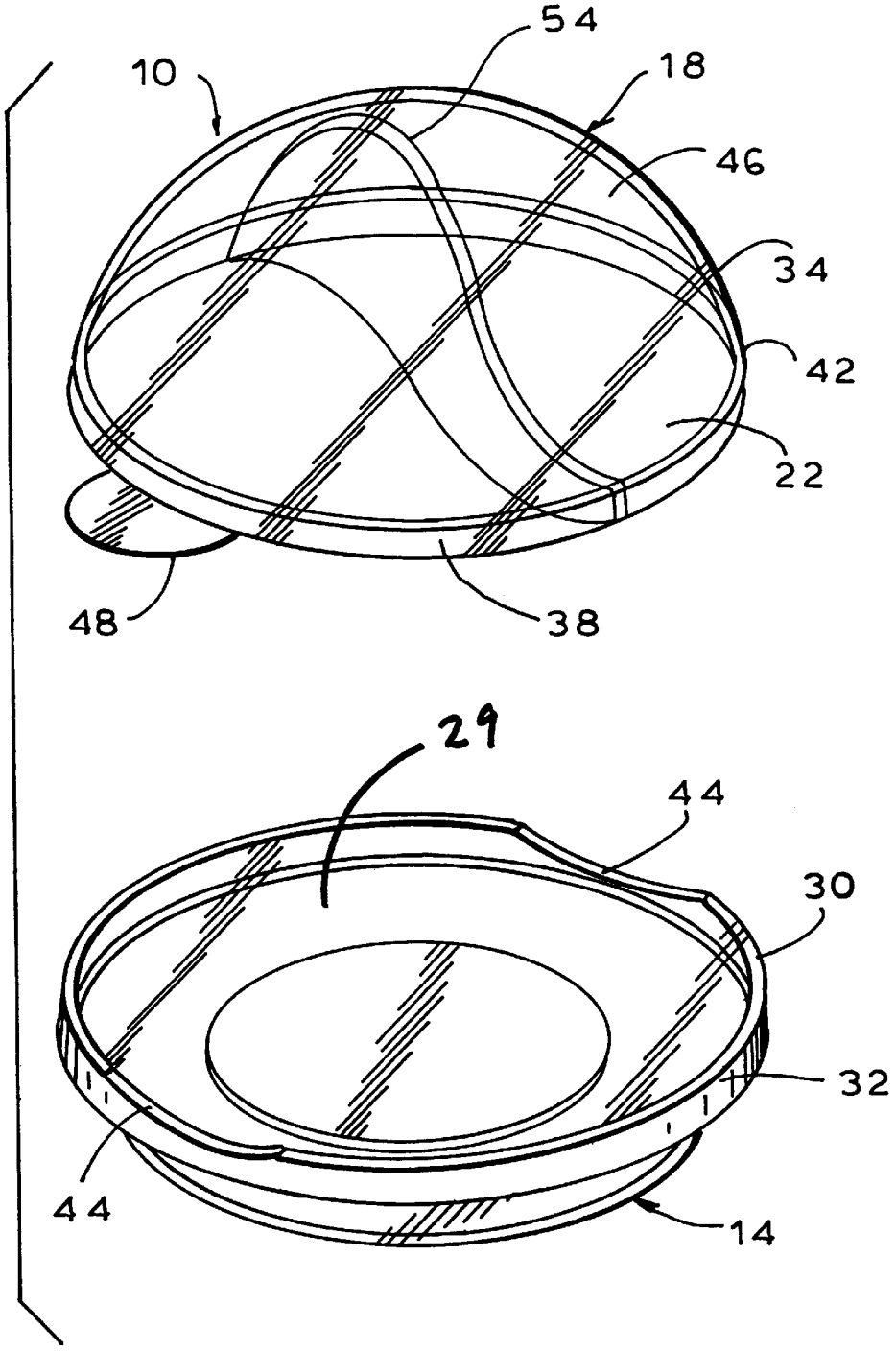
FIG. 6 is an exploded view thereof.

Referring to the drawing and in particular to FIGS. 1 and 6, therein illustrated is a multi-piece plastic container of the present invention, generally designated by the reference numeral 10. The container 10 includes a bottom or base section generally designated 14 having an open end, a transparent top or cover section generally designated 18 having an open end, and a seal 22 positioned between the base 14 and the cover 18 for closing off the open end of the cover section 18.

As further shown in FIG. 1, the cover section 18 is carried by the base 14. Although not shown in the figures, the cosmetic related products, e.g. capsules, are contained and displayed within the transparent cover 10 so as to be easily viewed by a consumer.

The base section 14 is preferably formed of a transparent plastic and comprises a substantially flat bottom wall 26 and a curved or arcuate sidewall 28 extending upwardly therefrom and preferably defining therewith a lower receptacle or enclosure 29. As shown in FIGS. 3–6, the sidewall 28 is joined at one end to the end wall 26 and extends upwardly therefrom to an upper edge or rim 30 of the base section 14.

Although the bottom wall 26 has been described as substantially flat, it should be noted that the entire base section 14 could be made substantially hemispherical in shape. The flat bottom wall 26, however, is considered preferable for securely seating the container 10 on a substantially flat bearing surface.

The base section 14 may also include a decorative band or collar 32 which is plainly visible by the consumer and may be used to carry indicia or information relating to the contents of the container 10. The information contained on the band 32 might include the type of product in the container or the tradename of a particular product. The information may be stenciled on the exterior of the band 32 or, alternatively, it may be deeply impressed in the band surface such as by engraving. Although not apparent in the figures, the band 32 is also preferably gilded or otherwise coated with a decorative finish to attract the consumer's attention to the information carried on the band 32.

As shown in FIG. 6, the band 32 is preferably affixed to the exterior of the sidewall 28 adjacent the open end and along the rim 30 of the base 14. The band 32 may be secured to the base 14 by an adhesive, heat welding or any other conventional means. Alternatively, the band 32 may be co-molded with the base section 14 and a decorative coating applied in a later step.

The top or cover section 18 of the container 10 includes a transparent dome or hemispherical shaped sidewall 34 which defines an upper receptacle or enclosure. As shown in FIGS. 6–8, the sidewall 34 extends downwardly and terminates adjacent the open lower end of the cover 18 in an integrally formed ring 38, ring which is configured and dimensioned to be received within the upper open end of the base section 14 (i.e., within band 32). Although the cover 18 has been shown as fitting within the upper open end of the base section 14, it should be appreciated that the container 10 maybe adapted such that the base section 14 is fitted within the cover section 18.

As shown further in FIGS. 7 and 8, at the junction of the ring 38 and the sidewall 34, the sidewall 34, which, at this point, has a greater diameter than that of the ring 38, forms an eave or overhang 42 which extends entirely about the periphery of the cover 18. As best seen in FIG. 8, the eave 42 rests against the rim 30 to support the cover 18 within the open end of the base 14. The rim 30 preferably also includes a pair of oppositely disposed notches or cut-outs 44, 44 for obtaining a finger grasp on the cover 18 along the eave 42 for facilitating separation of the cover 18 and the base 14 by the consumer.

As shown in FIG. 1, the second receptacle or enclosure of the cover 18 is closed off by the seal 22 to define an upper chamber 46. The cosmetic related products, e.g. capsules, are contained and displayed within the chamber 46 of cover 10 and are easily viewed by a consumer through the transparent sidewall 34. The seal 22 is preferably affixed across the ring 30 of the cover 18. The seal 22 may be a thin sheet of paper, foil, cardboard or plastic material and is not necessarily transparent. In fact, the surface of the seal 22 which carries the products preferably includes an opaque reflective coating which may serve to draw the consumer's attention to the product. The seal 22 is preferably loosely attached to the ring 30 by heat sealing or alternatively by means of a mild adhesive. If desired, the seal 22 may be easily tearable.

The capsules or other decorative cosmetic product in the upper compartment 46 are accessed by separating the seal 22 from the cover 18 and in at least some applications allowing the capsules to drop into the lower compartment 29 of the base 14. As shown in FIG. 6, the seal 22 may contain a grasping tab or extension 48 which extends beyond the perimeter of the container 10 to facilitate separation of the seal 22 from the ring 38. If the seal 22 is provided with a tab 48, it is preferable to position the tab 48 such that it extends over one of the cut-outs or notches 44, 44. In this manner, the tab 48 may also be used to provide a grasping surface which may be tugged upwardly to help lift the cover 18 from the base 14.

As best seen in FIGS. 1 and 6, the cover preferably include a partition or dividing wall 54 which separates the chamber 46 into first and second compartments 56, 58. The compartments 56, 58 may be used to separately contain and display, for example, an eye related product in the first compartment 56 and a face related product in the second compartment 58. The partition 54 preferably has a sinuous or S-shaped appearance to enhance the overall aesthetic effect of the container and is preferably made of the type of transparent plastic used to fabricate the cover 18.

Now that the preferred embodiments of the present have been shown and described in detail, various modifications and improvements thereon will become readily apparent to those skilled in the art. Accordingly, the spirit and scope of the present invention is to be construed broadly and limited only by the appended claims, and not by the foregoing specification.

What is claimed is:

1. A container for initially displaying at least one cosmetic-related product, comprising:

a cover defining a transparent upper viewing chamber having an open bottom;

a single seal member, said seal member extending across and affixed to said cover for sealing off said bottom and closing said chamber, said seal member being removable or rupturable;

at least one cosmetic-related product disposed in said closed chamber;

a base member defining a lower enclosure having an open top vertically aligned below said seal member, said enclosure being configured and dimensioned to receive and contain said product; and means for separably mounting said cover on said base member.

2. The container of claim 1 wherein said base member is transparent.

3. The container of claim 1 wherein said cover further comprises a partition for dividing said closed chamber into first and second compartments for separately containing and initially displaying said at least one product and another at least one product, respectively, said enclosure of said base member being configured and dimensioned to receive and contain in its entirety one of said at least one product and said another at least one product.

4. The container of claim 3 wherein said partition is integrally formed with said cover.

5. The container of claim 1 wherein said base member further comprises a substantially flat bottom wall for seating said container on an equally flat bearing surface.

6. The container of claim 1 further comprising a band affixed to an outer wall of said base member for displaying indicia related to said at least one product contained within said container.

7. The container of claim 1 wherein said seal member is opaque and includes a tab portion for facilitating removal of said seal member from said cover.

8. The container of claim 1 wherein said base member includes at least one notch for facilitating separation of said cover from said base member.

9. The container of claim 1 wherein said mounting means comprises a ring integrally formed with said cover and configured and dimensioned to be received within said base member for removably fitting together said cover and said base member.

* * * * *